United States Patent [19]

Robeck et al.

[11] Patent Number: 5,073,291

[45] Date of Patent: Dec. 17, 1991

[54] AZEOTROPE-TYPE SOLVENT MIXTURE OF METHANOL AND 1,4-DIHYDROPERFLUOROBUTANE AND PROCESS FOR CLEANING ELECTRONIC COMPONENTS WITH THE AID OF THE SAME

[75] Inventors: Horst Robeck; Hans-Matthias Deger, both of Hofheim am Taunus; Klaus Raab, Burgkirchen, all of Fed. Rep. of Germany

[73] Assignee: Hoechst Aktiengesellschaft, Frankfurt am Main, Fed. Rep. of Germany

[21] Appl. No.: 644,512

[22] Filed: Jan. 23, 1991

[30] Foreign Application Priority Data

Jan. 25, 1990 [DE] Fed. Rep. of Germany ..... 4002120

[51] Int. Cl.[5] ..... C11D 7/30; C11D 7/50; C23G 5/028; B06B 3/00

[52] U.S. Cl. ..... 252/171; 134/12; 134/31; 134/38; 134/39; 134/40; 203/67; 252/162; 252/170; 252/364; 252/DIG. 9

[58] Field of Search ..... 252/162, 170, 171, 172, 252/364, DIG. 9, 67; 134/12, 31, 38, 39, 40; 203/67

[56] References Cited

U.S. PATENT DOCUMENTS

| | | | |
|---|---|---|---|
| 3,927,129 | 12/1975 | Hazeldine et al. | 260/653.1 R |
| 3,960,746 | 6/1976 | Gorski | 252/171 |
| 4,157,979 | 6/1979 | Walters | 252/162 |
| 4,810,412 | 3/1989 | Merchant et al. | 252/171 |
| 4,816,174 | 3/1989 | Lund et al. | 252/171 |
| 4,842,764 | 6/1989 | Lund et al. | 252/171 |

FOREIGN PATENT DOCUMENTS

| | | | |
|---|---|---|---|
| 2221386 | 9/1990 | Japan | 252/172 |
| 1026003 | 4/1966 | United Kingdom . | |
| 1399867 | 7/1975 | United Kingdom . | |

OTHER PUBLICATIONS

Chemical Abstract No. 82(19):118757y, Abstract of Burns et al. "Fluorine Compounds in Anesthesia, 8, Examination of Seven Derivatives of Propane and Three of Normal Butane", *Anesthesia* 29(4 1974, pp. 435–444.

*Primary Examiner*—Paul Lieberman
*Assistant Examiner*—Linda D. Skaling

[57] ABSTRACT

The invention relates to an azeotrope-type mixture which contains about 3–5% by weight of methanol and about 95–97% by weight of 1,4-dihydroperfluorobutane, and also to a process for cleaning electronic components, in particular soldered conductor boards or printed circuits, with the aid of said mixture.

6 Claims, No Drawings

NOVEL AZEOTROPE-TYPE SOLVENT MIXTURE OF METHANOL AND 1,4-DIHYDROPERFLUOROBUTANE AND PROCESS FOR CLEANING ELECTRONIC COMPONENTS WITH THE AID OF THE SAME

DESCRIPTION

It is the prior art to use mixtures of 1,1,2-trichloro-1,2,2-trifluoroethane (R 113) and alcohols such as methanol, ethanol or 2-propanol to clean soldered conductor boards and other electronic components (British Patent Specification 1,026,003, British Patent Specification 1,399,867). U.S. Pat. No. 3,960,746 discloses an azeotrope-type mixture of R 113, methanol and nitromethane for the same purpose. Since, however, CFCs are suspected of damaging the ozone layer, it is necessary to dispense with this category of substance.

For the field of the electronics industry, in particular, for cleaning conductor boards after the soldering operation, various systems with an aqueous base and with a base of unhalogenated organic solvents are at present being discussed. In the case of aqueous cleaning agents, it is, however, difficult to find the correct surfactant-/complexing agent combination. The system also has to be adapted to the mechanical treatment such as rinsing, brushing, steam jet treatment and ultrasonic treatment. In the case of the SMT (surface mounted technology) technique, aqueous cleaning systems are frequently ruled out since the water can only be removed again with difficulty.

If unhalogenated organic solvents such as petrol, alcohols, terpenes or esters are used, an explosion-protected design of the system is necessary owing to the flammability and the explosiveness of these substances, with the result that any use in surface treatment systems is only possible in a few cases for economic reasons. Surprisingly, it has now been found that 1,4-dihydroperfluorobutane ($CHF_2$—$CF_2$—$CF_2$—$CHF_2$) forms an azeotrope-type solvent mixture with methanol, which mixture is eminently suitable for cleaning electronic components, in particular soldered conductor boards or printed circuits, especially for removing soldering fluxes.

One subject of the invention is an azeotrope-type mixture which contains about 3–5% by weight of methanol and about 95–97% by weight of 1,4-dihydroperfluorobutane. Preferably, the mixture contains 3.2–4.0% by weight of methanol, in particular 3.4–3.6% by weight of methanol, the remainder being 1,4-dihydroperfluorobutane in all cases. A further subject of the invention is a process for cleaning electronic components, in particular soldered conductor boards of printed circuits, which process comprises washing the components with an azeotrope-type mixture which contains about 3–5 per cent by weight of methanol and 95–97% by weight of 1,4-dihydroperfluorobutane. Preferably, a mixture is used which contains 3.2–4.0% by weight of methanol, in particular 3.4–3.6% by weight of methanol, the remainder being essentially 1,4-dihydroperfluorobutane in all cases.

A particularly preferred solvent mixture contains 96.5% by weight of 1,4-dihydroperfluorobutane and 3.5% by weight of methanol and has a boiling point at 1 bar of 40.5° C.

In the case of the mixture according to the invention, the composition of the vapour is identical, or essentially identical, to the composition of the liquid, i.e. the composition of the mixture does not change, or does not change substantially, during evaporation. The solvent mixture according to the invention has the further advantage that it contains no chlorine and, as a consequence, does not bring about any ozone damage. In addition, it is nonflammable and can be used in the standard ultrasonic, immersion and brush-washing systems.

EXAMPLE 1

A glass-fibre reinforced base material for polyester-based conductor boards was coated with a commercial soldering flux (Zeva C20-200 supplied by Zevatron, main component colophonium, accompanied by activators) and dried for 18 hours at 60° C. in a drying oven. Then the material was washed with a mixture of 1,4-dihydroperfluorobutane (96.5% by weight) and methanol (3.5% by weight) using ultrasound. The exposure time was 5 seconds, and the flux was completely removed.

EXAMPLE 2

The procedure was as in Example 1, except that another soldering flux was used (Zeva C 30-300 supplied by Zevatron) which again contains colophonium as main component, accompanied by activators. After an exposure time of 10 seconds, the flux was completely removed. On the other hand, in the case of the conventional mixtures consisting of 1,1,2-trichloro-1,2,2-trifluoroethane with methanol, ethanol or 2-propanol, the treatment times are between 60 and 90 seconds depending on the flux. In addition, ionic residues can be removed better with the azeotrope than with the conventional mixtures.

We claim:

1. An azeotrope-type solvent mixture which contains about 3–5% by weight of methanol and 95–97% by weight of 1,4-dihydroperfluorobutane

2. An azeotrope-type mixture as claimed in claim 1, which contains about 3.2–4.0% by weight of methanol and about 96.0–96.8% by weight of 1,4-dihydroperfluorobutane, said mixture having a boiling point at 1 bar of about 40.5° C. and wherein the composition of said mixture does not substantially change upon evaporation.

3. An azeotrope-type mixture as claimed in claim 1, which contains about 3.4–3.6% by weight of methanol and 96.4–96.6% by weight of 1,4-dihydroperfluorobutane.

4. A process for cleaning electronic components, which comprises washing the components with an azeotrope-type mixture as claimed in claim 1.

5. A process for removing soldering fluxes, from electronic components comprising washing said components with an azeotrope-type mixture as claimed in claim 1.

6. A process according to claim 4 wherein said electronic components are soldered circuit boards or printed circuits.

* * * * *